US006368020B1

(12) United States Patent
Heijmans et al.

(10) Patent No.: US 6,368,020 B1
(45) Date of Patent: Apr. 9, 2002

(54) LINING ELEMENT FOR A DRILLED TUNNEL

(75) Inventors: Ronaldus Wilhelmus Maria Gerardus Heijmans, Utrecht; Jozef Antonius Gerardus Jansen, Amersfoort; Adrianus Alphonsus Johannes Reijgersberg, Delft, all of (NL)

(73) Assignee: Arcadis Bouw/Infra B.V. (NL)

( * ) Notice: Subject to any disclaimer, the term of this patent is extended or adjusted under 35 U.S.C. 154(b) by 0 days.

(21) Appl. No.: 09/286,069

(22) Filed: Apr. 5, 1999

(30) Foreign Application Priority Data

Apr. 9, 1998 (NL) ..... 1008849

(51) Int. Cl.[7] ..... F21D 11/08
(52) U.S. Cl. ..... 405/151; 405/135
(58) Field of Search ..... 405/132, 134, 405/135, 136, 137, 146, 147, 150.1, 151, 152, 153

(56) References Cited

U.S. PATENT DOCUMENTS

| | | | | |
|---|---|---|---|---|
| 1,004,288 A | * | 9/1911 | McAlpine | 405/151 |
| 1,969,810 A | | 8/1934 | McAlpine | |
| 1,976,628 A | * | 10/1934 | O'Rourke | 405/151 |
| 3,671,346 A | | 6/1972 | Tsuzuki | |
| 4,075,855 A | * | 2/1978 | Meldner | 405/151 |
| 4,497,590 A | * | 2/1985 | Chase | 405/152 |
| 4,545,701 A | * | 10/1985 | Tsuzuki | 405/153 |
| 4,662,773 A | * | 5/1987 | Baumann et al. | 405/152 |
| 5,040,921 A | * | 8/1991 | Torok | 405/152 |

FOREIGN PATENT DOCUMENTS

| | | |
|---|---|---|
| CH | 516 049 | 11/1971 |
| DE | 25 27 743 A 1 | 12/1976 |
| EP | 0 100 771 A1 | 2/1984 |
| EP | 0 624 714 A2 | 11/1994 |
| EP | 0 716 216 A2 | 6/1996 |
| FR | 2 435 599 | 4/1980 |
| FR | 2 526 856 | 11/1983 |
| FR | 2 688 252 A1 | 9/1993 |
| GB | 1 232 299 | 5/1971 |
| GB | 2 055 413 A | 3/1981 |
| GB | 2 124 679 A | 2/1984 |
| NL | 7602870 | 12/1976 |
| NL | 7 908 161 | 3/1980 |

* cited by examiner

*Primary Examiner*—David Bagnell
*Assistant Examiner*—Frederick L. Lagman
(74) *Attorney, Agent, or Firm*—Akin, Gump, Strauss, Hauer & Feld, L.L.P.

(57) ABSTRACT

The invention relates to a concrete lining element for a drilled tunnel, which element is formed as a ring segment and is internally reinforced, and a plurality of which ring segments can be joined together to form a ring, and a plurality of rings can be joined to form the lining for the drilled tunnel and wherein, in order to couple adjacent rings at the intermediate ring joint, each element is provided at one side bordering the ring joint with at least one projection, and at the opposed side with a corresponding recess to admit the projection of an adjacent element. The height of the projection, respectively the depth of the recess on the respective side is between 30 and 60 mm, and the projection, respectively the recess at the transition from its top, respectively its bottom to its side walls, possesses rounded comers, having a radius of rounding of between 5 and 50 mm.

4 Claims, 2 Drawing Sheets

LINING ELEMENT FOR A DRILLED TUNNEL

BACKGROUND OF THE INVENTION

The invention relates to a concrete lining element for a drilled tunnel, which element is formed as a ring segment and is internally reinforced, and a plurality of which ring segments can be joined together to form a ring, and a plurality of rings can be joined to form the lining for the drilled tunnel and wherein, in order to couple adjacent rings at the intermediate ring joint, each element is provided at one side bordering the ring joint with at least one projection, and at the opposed side with a corresponding recess to intermate with the projection of an adjacent element.

This kind of known, prefabricated drilled tunnel lining elements is used to line the inside of drilled tunnels. The rings are formed of a plurality of joined elements which extend in the circumferential direction of the drilled is tunnel, while said rings are joined in the longitudinal direction of the drilled tunnel. Between adjacent rings there is a so-called ring joint.

When a tunnel is being drilled in relatively soft ground as, for instance, is usually the case in the Netherlands, it is essential that the separate drilled tunnel lining elements are joined together in order to limit deformation of the drilled-tunnel lining and consequently of the tunnel. However, such reciprocal connections generate forces in the drilled tunnel lining elements that may result in unwanted damage. It has been shown, for example, that due to the loads that have to be absorbed, cracks may develop starting from the recess, which is detrimental to the strength of the joint. Removal (repair) of the occurring damage involves high costs.

SUMMARY OF THE INVENTION

The object of the present invention is to improve a lining element for a drilled tunnel of the above-mentioned kind such, that the strength of the element at the joint between adjacent elements can be appreciably improved. In order to achieve this objective the drilled tunnel lining element according to the invention is characterized in that the height of the projection, respectively the depth of the recess on the respective side is between 30 and 60 mm, and in that the projection, respectively the recess at the transition from its top, respectively its bottom to its side walls, possesses rounded corners, having a radius of rounding of between 5 and 50 mm.

Embodying the drilled tunnel lining element in this manner has shown that the joint between the adjacent elements can be three to five times as strong as with conventional known drilled tunnel lining elements, with the height of the projection, respectively the depth of the recess being, for example, 19 mm, while the radius of the rounding at the transition from the top of the projection, respectively the bottom of the recess to its side wall is not very significant. Thanks to the design according to the invention higher loads can be absorbed without exhibiting any undesirable damage to the drilled tunnel lining elements.

In accordance with a preferred embodiment the design of the drilled tunnel lining element may be further optimized by arranging that the aperture angle of the sidewalls of the projection, respectively the recess is between 30° and 45°.

The aperture angle of the side walls is understood to mean the angle between the side walls and the line perpendicular to the respective side. This measure, in combination with the measures mentioned earlier regarding the height, respectively the depth and radius of rounding result in a drilled tunnel lining element with excellent characteristics.

The drilled tunnel lining elements to which the present invention relates are usually of the kind wherein the projection is formed like a truncated pyramid with a substantially rectangular base. In such a case the ratio between the length and the width of the base is at most 1.3. By limiting this ratio it is possible to keep the length of the projection at the base as small as possible, which then naturally also applies to the recess. In this manner there is sufficient space around the recess for applying a suspension reinforcement, so that the strength of the drilled tunnel lining element, especially at the side provided with the recess, can be further improved.

In this respect it is further preferable that the internal reinforcement extends in the direction of the element's side provided with the recess, at least to the plane through the bottom of the recess. This measure also contributes to improving the strength of the drilled tunnel lining element at the side provided with the recesses.

Within the above-mentioned ranges for the projections height, respectively the depth of the recess, the radius of rounding and the aperture angle of the side walls, particular values have been shown to be especially advantageous. For example, a particularly preferred height of projection, respectively depth of recess is 40 mm. The radius of rounding in a favourable embodiment is 15 mm, and an aperture angle of 35° will provide an advantageous result.

It should be noted that there is a connection between most of the above-mentioned measures according to the invention. In combination they lead to an optimal result, although each individual measure already improves the drilled tunnel lining element compared with a known existing element.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise arrangements and instrumentalities shown. In the drawings.

DETAILED DESCRIPTION OF THE INVENTION

Figure 1:
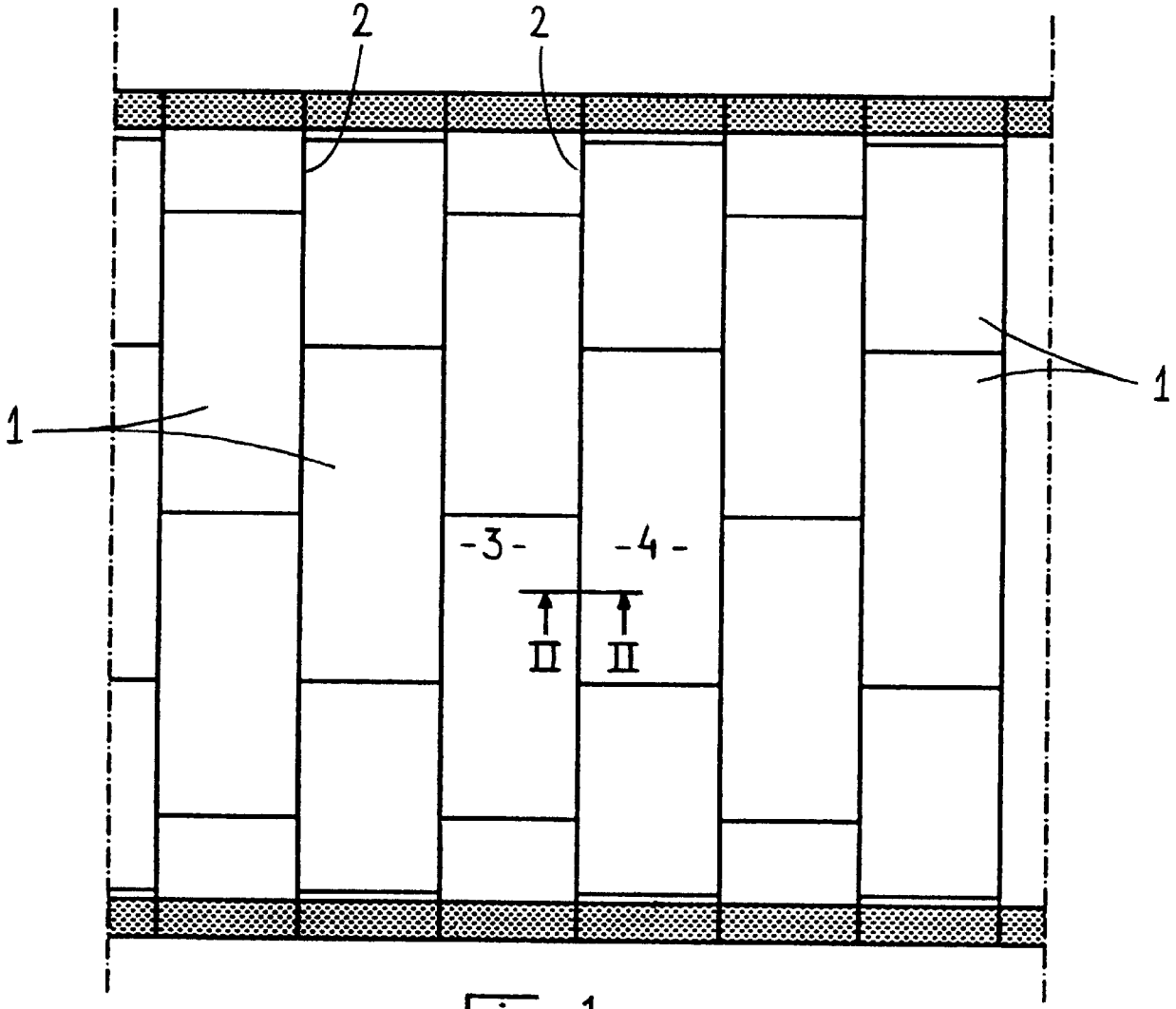
FIG. 1 shows a partial longitudinal section through a drilled tunnel, lined with drilled tunnel lining elements in accordance with the invention.

The longitudinal section through a drilled tunnel represented in FIG. 1 shows drilled tunnel lining elements 1 that are joined such as to form adjacent rings in the longitudinal direction of the drilled tunnel. Between two adjacent rings there is always a ring joint 2. In order to be able to couple adjacent rings at the intermediate ring joints 2, the drilled tunnel lining elements 1 are provided with intermating projections and recesses in their respective sides, as will be explained in more detail in FIG. 2.

As the tunnel drilling proceeds, the drilled tunnel lining elements 1 are successively assembled into the consecutive rings , so that the tunnel portion directly behind the drilling gear is progressively being lined.

Figure 2:
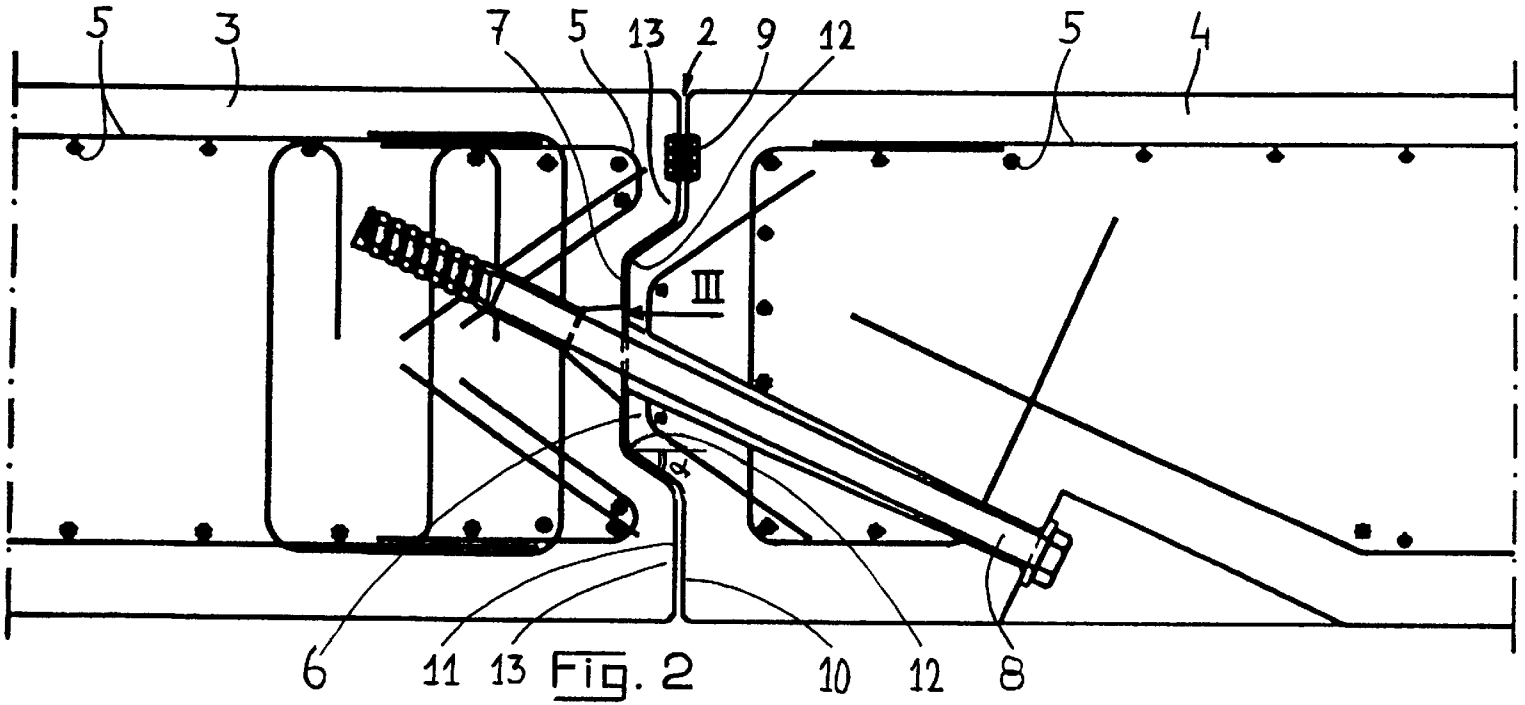
FIG. 2 shows a cross section according to line II—II in FIG. 1.

FIG. 2 shows on a larger scale the cross section II—II indicated in FIG. 1. The illustration shows portions of two adjacent drilled tunnel lining elements 3 and 4. Said elements 3 and 4 belong to two adjacent rings constructed from elements, which are separated from each other by a joint 2. Basically, both elements 3 and 4 are constructed similarly, and FIG. 2 shows one side of the one element 3 and the opposed side of the other element 4. As is usual, the elements 3, 4 are provided with an internal reinforcement 5, providing the material of the elements, i.e. concrete, with the required strength.

Each element 3, 4 possesses at one side at least one projection 6 (illustrated in FIG. 2, in relation to element 4), while the opposing side (shown in relation to element 3) is provided with a corresponding recess 7. When two adjacent elements 3 and 4 are coupled with the aid of a coupling bolt 8, in a manner that is known in itself, the projection 6 fits with ease into the recess 7.

Also shown is a sealing section 9 for sealing off the joint 2.

The height of the projection 6 with regard to the element's respective side 10, is between 30 and 60 mm. Correspondingly, the depth of the recess 7 with regard to the element's respective side 11 is also between 30 and 60 mm. In addition, the projection 6, at the transition from its top to its side walls (in FIG. 2 this transition is indicated by reference number 12) possesses rounded comers, having a radius of rounding between 5 and 50 mm. Correspondingly, the transition between the bottom of the recess and its side walls of course also possesses rounded comers having a radius of rounding between 5 and 50 mm.

Combining the two above-mentioned measures regarding the height of the projection 6, respectively the depth of the recess 7, and the radius of rounding of said comers, considerably improves the strength of the joint between the adjacent elements 3 and 4. Especially the occurrence of damage in the coupling region can be avoided. In the known elements such damage often manifests itself in the form of cracks, starting at the transition between the bottom and the side walls of the recess 7. However, due to the fact that now the projection 6 and the recess 7 possess the above-mentioned height, respectively depth, it is possible to allow the reinforcement 5 to extend at the side of the element provided with the recess 7, preferably to the plane through the bottom of the recess 7. It is even possible to allow the reinforcement to extend to the so-called tooth 13 of the element (in FIG. 2, this can be seen in relation to element 3). Crack formation starting from said transition between the bottom and the side walls of the recess 7 is then effectively prevented by the reinforcement 5.

According to experience, exceptionally good results have been obtained with the projection 6 having a height, respectively the recess 7 having a depth of 40 mm, and said corners having a radius of rounding of 15 mm.

It is also possible to influence the strength of the coupling between adjacent elements 3 and 4 by suitably selecting a so-called aperture angle for the side walls of the projection 6, respectively the recess 7. Said aperture angle is the angle between the side walls and the line perpendicular to the respective side, and is indicated in FIG. 2 by angle a. A choice of angle between 30° And 45°, and in particular 35° has been shown to yield good results.

The projection 6 provided for drilled tunnel lining elements of the present kind, is usually formed like a truncated pyramid with a substantially rectangular base. By ensuring that the ratio between length 1 and width b (see FIG. 3) of the base is at most 1.3, it is possible to keep the length of the projection to a limit, so that a so-called suspension reinforcement can be provided around it, to improve the strength of the projection.

Figure 3:
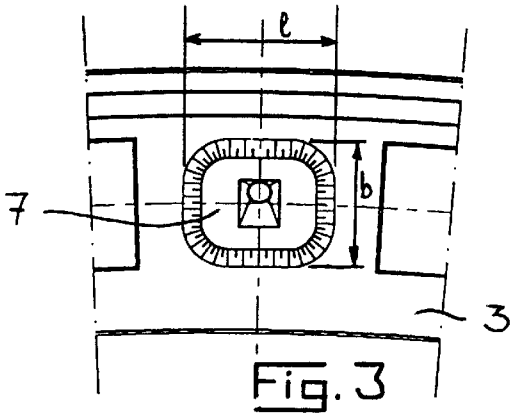
FIG. 3 shows a view according to III in FIG. 2.

For the sake of completeness it should be noted that FIG. 3 shows the length 1 and width b of the recess 7; since the recess 7 and the projection 6 are shaped in concordance, FIG. 3 may also serve to illustrate the respective dimensions of a projection 6.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

We claim:

1. A concrete lining element for a drilled tunnel, which element is formed as a ring segment and is internally reinforced, and a plurality of which ring segments can be joined together to form a ring, and a plurality of rings can be joined to form a lining for the drilled tunnel and wherein, in order to couple adjacent rings at an intermediate ring joint, each element is provided at one side bordering the ring joint with at least one projection, and at an opposed side with a corresponding recess to intermate with the projection of an adjacent element, wherein a height of the projection and a depth of the recess on the opposed side, is between 30 and 60 mm, and the projection has a radius of rounding of between 5 and 50 mm, at a transition from a top of the projection to side walls of the projection the recess has a radius of rounding of between 5 and 50 mm, at a transition from a bottom of the recess to side walls of the recess; and wherein the projection is formed like a truncated pyramid with a substantially rectangular base, a ratio between a length and a width of the base being at most 1.3.

2. A concrete lining element for a drilled tunnel, which element is formed as a ring segment and is internally reinforced, and a plurality of which ring segments can be joined together to form a ring, and a plurality of rings can be joined to form a lining for the drilled tunnel and wherein, in order to couple adjacent rings at an intermediate ring joint, each element is provided at one side bordering the ring joint with at least one projection, and at an opposed side with a corresponding recess to intermate with the projection of an adjacent element, wherein a height of the projection and a depth of the recess on the opposed side, is 40 mm, the projection has a radius of rounding of between 5 and 50 mm, at a transition from a top of the projection to side walls of the projection and the recess has a radius of rounding of between 5 and 50 mm, at a transition from a bottom of the recess to side walls of the recess.

3. A concrete lining element for a drilled tunnel, which element is formed as a ring segment and is internally reinforced, and a plurality of which ring segments can be joined together to form a ring, and a plurality of rings can be joined to form a lining for the drilled tunnel and wherein, in order to couple adjacent rings at an intermediate ring joint, each element is provided at one side bordering the ring joint with at least one projection, and at an opposed side with a corresponding recess to intermate with the projection of an adjacent element, wherein a height of the projection and a depth of the recess on the opposed side, is between 30 and 60 mm, and the projection has a radius of rounding of 15 mm, at a transition from a top of the projection to side walls of the projection and the recess has a radius of rounding of between 5 and 50 mm, at a transition from a bottom of the recess to side walls of the recess.

4. A concrete lining element for a drilled tunnel, which element is formed as a ring segment and is internally reinforced, and a plurality of which ring segments can be joined together to form a ring, and a plurality of rings can be joined to form a lining for the drilled tunnel and wherein, in order to couple adjacent rings at an intermediate ring joint, each element is provided at one side bordering the ring joint with at least one projection, and at an opposed side with a corresponding recess to intermate with the projection of an adjacent element, wherein a height of the projection and a depth of the recess on the opposed side, is between 30 and 60 mm;

the projection has a radius of rounding of between 5 and 50 mm, at a transition from a top of the projection to side walls of the projection;

the recess has a radius of rounding of between 5 and 50 mm, at a transition from a bottom of the recess to side walls of the recess; and an aperture angle of the sidewalls of the projection and the recess, is 35°.

* * * * *